US007014072B2

(12) United States Patent
Yquel

(10) Patent No.: US 7,014,072 B2
(45) Date of Patent: Mar. 21, 2006

(54) VALVE FOR A PRESSURIZED RECEPTACLE

(75) Inventor: Jean-Pierre Yquel, Colombes (FR)

(73) Assignee: L'Oreal, (FR)

( * ) Notice: Subject to any disclaimer, the term of this patent is extended or adjusted under 35 U.S.C. 154(b) by 0 days.

(21) Appl. No.: 10/648,006

(22) Filed: Aug. 26, 2003

(65) Prior Publication Data

US 2004/0074929 A1 Apr. 22, 2004

Related U.S. Application Data

(60) Provisional application No. 60/412,784, filed on Sep. 24, 2002.

(30) Foreign Application Priority Data

Aug. 30, 2002 (FR) ..... 02 10780

(51) Int. Cl.
*B65D 83/00* (2006.01)

(52) U.S. Cl. ..... 222/402.1; 222/402.2

(58) Field of Classification Search ..... 222/402.1, 222/402.2, 402.13, 402.21, 477, 500
See application file for complete search history.

(56) References Cited

U.S. PATENT DOCUMENTS 2,141,871 A * 12/1938 Koukal ..... 222/477
2,432,923 A * 12/1947 Newman ..... 222/477
2,519,479 A * 8/1950 Koukal ..... 222/477
2,745,576 A * 5/1956 Chappell ..... 222/477
2,778,543 A * 1/1957 Urlaub ..... 222/402.2
2,831,618 A * 4/1958 Soffer et al. ..... 222/402.22
3,167,220 A * 1/1965 Koukal ..... 222/477
3,169,677 A * 2/1965 Focht ..... 222/402.2
4,117,958 A * 10/1978 Spitzer et al. ..... 222/402.18
5,147,357 A 9/1992 Rose et al.
5,520,310 A * 5/1996 Bauer et al. ..... 222/402.2

FOREIGN PATENT DOCUMENTS

FR 2 680 161 A1 2/1993
FR 2 736 702 A1 1/1997

* cited by examiner

*Primary Examiner*—Philippe Derakshani
(74) *Attorney, Agent, or Firm*—Lerner, David, Littenberg, Krumholz & Mentlik, LLP

(57) ABSTRACT

Valves for use with a pressurized receptacle are disclosed comprising a housing including an orifice for dispensing a fluid, a shutter disposed in the housing and movable along the axis of the housing under the action of gravity between a closed position in which the shutter substantially closes the orifice when the valve is in a predetermined orientation and a dispensing position in which the shutter releases the orifice, and at least one surface adapted to prevent movement of the shutter parallel to the axis of the housing over at least a portion of the patch between the closed position and the dispensing position.

34 Claims, 3 Drawing Sheets

VALVE FOR A PRESSURIZED RECEPTACLE

CROSS-REFERENCE TO RELATED APPLICATIONS

This application claims the benefit of the filing date of U.S. Provisional Patent Application No. 60/412,784 filed Sep. 24, 2002, the disclosure of which is hereby incorporated by reference.

FIELD OF THE INVENTION

The present invention relates to valves for pressurized receptacles.

BACKGROUND OF THE INVENTION

French patent application FR-A-2 680 161 describes a valve for a pressurized receptacle that includes a shutter member constituted by a ball, the shutter member serving, when the receptacle is not in a normal position of use, to close an orifice through which the fluid passes for dispensing, thereby ensuring that actuating the valve does not lead to a loss of propellant gas alone, for example.

However, if the user shakes the receptacle vertically while dispensing the fluid, there is a danger of the ball coming into contact with its seat and then remaining pressed against the seat under the effect of the pressure that exists inside the receptacle.

In order to avoid the shutter member remaining in that closed position, a leak is provided between the inside of the valve body and the inside of the receptacle by means of a micro-orifice that passes through the valve body.

Making such a micro-orifice is relatively difficult and complicates manufacture of the valve.

In addition, the valve includes a gasket which is liable to swell on coming into contact with the fluid contained in the receptacle, and swelling of the gasket is liable to disturb the flow of propellant gas through the micro-orifice, thereby further complicating implementation of the valve.

One object of the present invention is thus to improve the operation of such a valve that includes a shutter member that is movable under the action of gravity, and seeks in particular to avoid the shutter member disturbing the operation of the valve in the event of the receptacle being moved while fluid is being dispensed and/or in the event of it being entrained by the fluid.

SUMMARY OF THE INVENTION

In accordance with the present invention, this and other objects have now been realized by the invention of a valve for use with a pressurized receptacle containing a fluid to be dispensed therefrom, the valve comprising a housing having an axis, and including an orifice for dispensing the fluid, a shutter member disposed in the housing, the shutter member movable along the axis under the action of gravity between a closed position in which the shutter member substantially closes the orifice when the valve is in a predetermined orientation and a dispensing position in which the shutter member releases the orifice, and at least one surface adapted to prevent movement of the shutter member parallel to the axis over at least a portion of the path between the closed position and the dispensing position. In one embodiment the at least one surface is adapted to inhibit the movement of the shutter member over at least a portion of the patch between the closed portion and the dispensing portion. Preferably, the at least one surface is adapted to impart a helical motion to the shutter member.

In accordance with one embodiment of the valve of the present invention, the at least one surface comprises a threaded rod including at least one thread which cooperates with the inner wall of the housing to define a substantially helical passage constraining the movement of the shutter member between the closed position and the dispensing position.

In accordance with another embodiment of the valve of the present invention, the at least one surface comprises a helical groove in the inner wall of the housing and a rod within the housing constraining the movement of the shutter member along the helical groove between the closed position and the dispensing position. Preferably, the threaded rod includes an inner channel for the flow of the fluid towards the orifice. In another embodiment, the threaded rod is free of an inner channel which would permit flow of the fluid towards the orifice therethrough.

In accordance with another embodiment of the valve of the present invention, the at least one surface comprises at least one deflector within the housing, the at least one deflector providing an obstacle deflecting the movement of the shutter member between the closed position to the dispensing position. Preferably, the at least one deflector comprises at least one separate element affixed to the wall of the housing. In another embodiment, the at least one deflector comprises at least one integral element formed integrally with the wall of the housing.

In accordance with one embodiment of the valve of the present invention, the housing comprises a valve body.

In accordance with another embodiment of the valve of the present invention, the valve includes a valve body, and at least a portion of the housing comprises a separate element affixed to the valve body.

In accordance with another embodiment of the valve of the present invention, the valve includes an absorber disposed downstream of the shutter member in the direction of flow of the fluid, the absorber adapted to absorb at least one propellant gas contained within the receptacle, whereby the absorber can release at least a portion of the at least one propellant gas upon a decrease in pressure in the area adjacent to the absorber. Preferably, the absorber comprises porous material. In another embodiment, the absorber comprises a material capable of absorbing the at least one propellant gas. Preferably, the at least one propellant gas is an alkane, a fluorine-containing compound or dimethyl ether.

In accordance with another embodiment of the valve of the present invention, the absorber comprises polyamide fibers, preferably nylon fibers. In accordance with another embodiment of the valve of the present invention, the absorber comprises a separate sintered member.

In accordance with another embodiment of the valve of the present invention, the absorber comprises silicone.

In accordance with another embodiment of the valve of the present invention, the housing comprises a valve body, and the valve includes a chamber in fluid communication with the valve body by means of the orifice, and the absorber is disposed within the chamber.

In accordance with another embodiment of the valve of the present invention, the predetermined orientation comprises a head-down position of the valve, and the position for normal use of the valve comprises a head-up position of the valve. In another embodiment, the predetermined orientation comprises a head-up position for the valve, and the position of normal use of the valve comprises a head-down position for the valve.

In accordance with another embodiment of the valve of the present invention, the valve includes actuating means for actuating the valve, the actuating means being actuated by being depressed. In another embodiment, the actuating means is actuated by being rocked.

In accordance with another embodiment of the valve of the present invention, the separate element comprises a dip tube.

In accordance with another embodiment of the valve of the present invention, the separate sintered member comprises a high porosity sintered member.

In accordance with the present invention, a dispensing device has also been devised comprising a pressurized receptacle and a valve as defined above.

In one embodiment of the present invention, a valve is provided for a pressurized receptacle, comprising:

an orifice configured to have a fluid for dispensing pass therethrough;

a shutter member disposed in a housing having an axis, the shutter member being movable along said axis under the action of gravity between a closing position taken when the valve is in a predetermined orientation, in which closing position the shutter member substantially closes the orifice, and a dispensing position in which the shutter member releases the orifice;

the valve being characterizable by including at least one surface configured to prevent any travel of the shutter member parallel to the axis of the housing over at least a fraction of the path of the shutter member between its dispensing position and its closing position.

The axis of the shutter member housing may be rectilinear or otherwise.

The present invention makes it possible to prevent the shutter member from being able to reach its closing position too quickly under the effect of the receptacle moving or under the effect of being entrained by the fluid, and consequently it diminishes greatly or even eliminates any risk of the shutter closing the orifice accidentally while dispensing the fluid.

The above-mentioned surface may be made in various ways.

In one embodiment of the present invention, the surface is configured to impose on the shutter member, particularly when it is constituted by a ball, a helical path between its closing position and its dispensing position.

Such a helical path may be obtained, for example, by placing a threaded rod inside the housing containing the shutter member, the rod having at least one thread which co-operates with the wall defining the housing for the shutter member to define a substantially helical passage which the shutter member must follow in order to reach its closing position.

The number of turns of the thread around the rod may be selected as a function of the length of time it is desired for the shutter member to spend traveling from its dispensing position to its closing position.

The helical passage may also be obtained by making a helical groove in the wall defining the housing for the shutter member and by placing a rod inside the housing that constrains the shutter member to move along the above-mentioned groove in order to reach its closing position The above-mentioned threaded or the non-threaded rod used in association with a groove may optionally include an internal channel enabling the fluid to flow towards the orifice which is closed by the shutter member when it is in its closing position.

The optional presence of such a channel makes it possible to avoid the shutter member being entrained towards its closing position by the flow of fluid while the valve is in operation.

The above-mentioned surface may also be configured so as to impose a path on the shutter member that is not entirely parallel to the axis of the housing, and that is other than helical.

For example, provision can be made for at least one deflector in the shutter member housing which defines the surface in question and constitutes an obstacle causing the shutter member to change direction as it moves from its dispensing position towards its closing position.

By way of example, the deflector may constitute a piece that is fitted inside the shutter member housing, for example being carried by a rod having one end secured to the wall defining the shutter member housing, or it may be made integrally with the wall defining the shutter member housing.

A plurality of deflectors may be disposed in such a manner so as to form at least one baffle along the path of the shutter member.

The housing containing the shutter member may be situated in the valve body or elsewhere, for example it may be defined at least in part by a piece which is fitted on the valve body, for example by a dip tube.

The valve may further comprise an absorber element situated downstream from the shutter member relative to the direction of fluid flow, suitable for absorbing at least one propellant gas contained in the receptacle and for releasing it at least in part when the pressure in the vicinity of the absorber becomes low enough. The absorber is particularly configured in such a manner that the quantity of propellant gas that is released is sufficient to reduce the pressure difference that exists across the shutter member in the event of it becoming blocked in its closing position so that the shutter member is no longer held in its closing position by gravity, thereby enabling the shutter member to leave its closing position.

Such an absorber advantageously replaces the micro-orifice described in above-mentioned French patent application FR-A-2 680 161.

The absorber may be of a material and/or with a physical structure that are selected as a function of the nature of the substances contained in the receptacle, in particular the nature of the propellant gas and the quantity of gas that is to be released by desorption, given for example, the configuration of the valve and the volume which the gas released by desorption is likely to occupy. The absorber may also be configured to take into account the weight of the shutter member and the pressure that exists inside the receptacle.

The absorber may comprise a porous material.

The absorber may also comprise a material whose chemical nature enables it to absorb a propellant gas contained in the fluid flowing through the valve.

The absorber may be configured so as to be capable of absorbing a selected propellant gas, e.g. a gas selected from the group constituted by: alkanes, in particular butane, isopropane, and isobutane; fluorine-containing compounds, in particular difluoroethane 152*a*, tetrafluoroethane 134*a*; and dimethyl ether.

By way of example, the absorber may comprise polyamide fibers, in particular fibers made of nylon. The absorber may also comprise a sintered piece, in particular a sintered piece having high porosity. The absorber may also comprise a silicone, in particular when the propellant gas is butane, isobutane, difluoroethane 152*a*, tetrafluoroethane 134*a*, or dimethyl ether.

The absorber may be situated in a chamber of the valve body that is in communication with the orifice that can be closed by the shutter member.

The absorber may be fixed on the valve body, for example. In a variant, or in addition, the absorber may also be fixed on the valve rod, in particular at one end thereof.

The above-mentioned predetermined orientation, i.e. the orientation of the valve in which the shutter member occupies its closing position, may constitute, for example, a position which corresponds to an attempt to use the valve in a head-down position. Under such circumstances, the receptacle is intended for use with the head in a head-up position for dispensing fluid contained inside it, and a dip tube can be fixed to the valve body.

In a variant, the predetermined orientation in which the shutter member occupies its closing position is a position which corresponds to an attempt at using the valve in the head-up position, whereas the normal position of use is a head-down position.

The valve may be configured to be actuated by being depressed or being rocked, for example.

The present invention also provides a packaging and dispenser device comprising:

a pressurized receptacle; and a valve as defined above.

BRIEF DESCRIPTION OF THE DRAWINGS

The present invention can be better understood on reading the following detailed description of non-limiting embodiments thereof, and on examining the accompanying drawings, in which.

DETAILED DESCRIPTION

Figure 1:
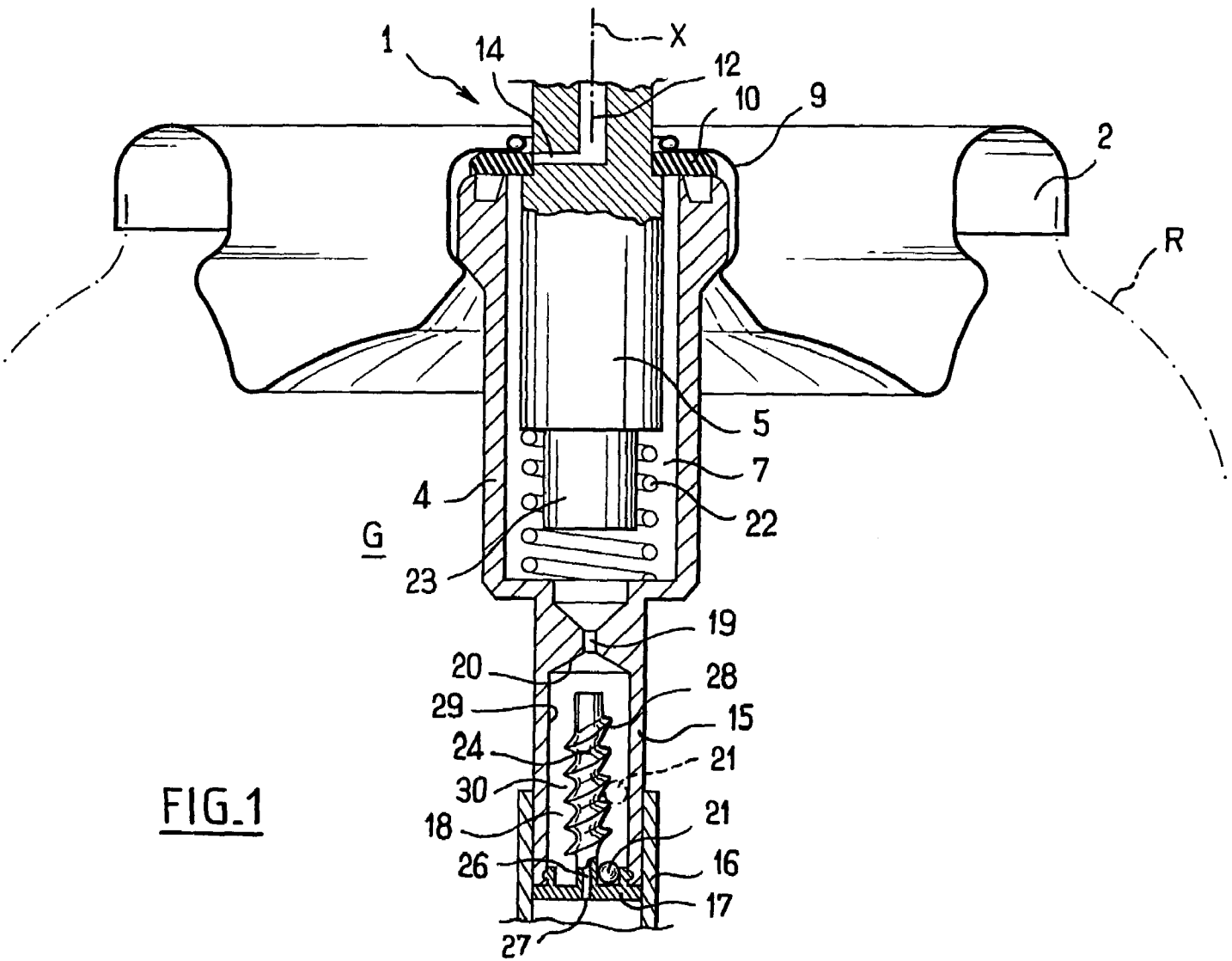
FIG. 1 is a side, elevational, partially sectional, fragmentary view of a receptacle fitted with a valve according to one embodiment of the present invention.

FIG. 1 shows a valve 1 in accordance with the present invention mounted on a pressurized receptacle R.

The receptacle R contains a fluid P for spraying under the pressure of a propellant gas G such as, for example, isobutane, butane, dimethyl ether, difluoroethane 152*a*, or tetrafluoroethane 134*a*.

At its top end, the receptacle R has an opening 2 with a cup 3 crimped thereon, and the valve 1 is fixed by crimping in a central housing 9 in the cup 3.

The valve 1 comprises a valve body 4 defining a chamber 7 in which a valve rod 5 having an axis X is engaged and is suitable for moving inside the chamber 7 between a valve-closed position and an open position in which the fluid P can be sprayed.

Figure 2:
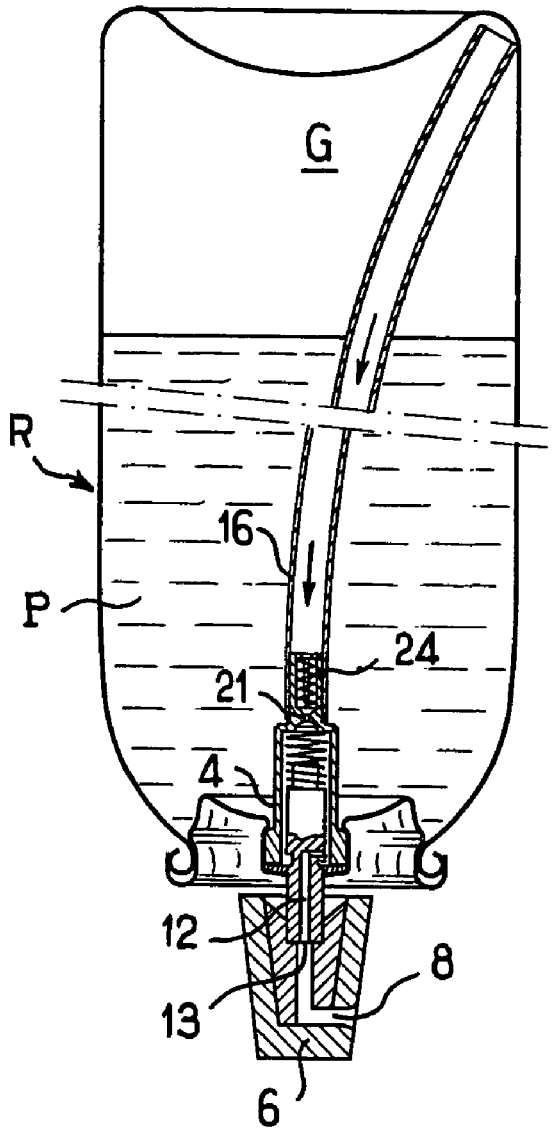
FIG. 2 is a side, elevational, partially sectional, fragmentary view of the receptacle shown in FIG. 1 in a head-down position.

The valve rod 5 is provided at its top end with a pushbutton 6, as can be seen in FIG. 2. The pushbutton is provided with an inside channel 8 and may be fitted with one or more nozzles having swirling channels, for example, depending on the type of aerosol that is desired.

A sealing washer 10 is interposed between the valve body 4 and the cup 3. The valve rod 5 is slidable in the valve body 4 along the axis X in a leaktight contact with the washer 10.

A dispensing channel 12 is made in the valve rod 5. This channel opens out into the top end of the valve rod 5 by means of an orifice 13. The channel also communicates with a radial orifice 14 which opens out in a side surface of the valve rod 5.

In the valve-closed position, as shown in FIG. 1, the orifice 14 is closed by the washer 10. In order to dispense the fluid P, the valve rod 5 is pushed down into the valve body 4 and the orifice 14 opens out on the other side of the washer 10. The fluid can then flow along the dispensing channel 12.

The valve 1 has a helical spring 22 urging the valve rod 5 towards the closed position, as shown in FIG. 1, whenever the user releases the valve rod.

At its bottom end, the valve rod 5 has a cylindrical portion 23 serving as a guide to the spring 22.

At its bottom end, the valve body 4 carries a spigot 15 which has a dip tube 16 fixed thereto. The bottom end of the spigot 15 is closed by an endpiece 17.

The spigot 15 co-operates with the endpiece 17 to define a housing 18 which communicates with the chamber 7 by means of an orifice 19, the orifice 19 being beside a tapering surface converging towards the orifice 19 and acting as a seat 20 for a shutter member 21 constituted by a ball of glass or of stainless steel, for example, where the material from which the shutter member is made is a function of the nature of the fluid and of the propellant gas, for example.

When the receptacle R is in its normal position for use, i.e. with its head up, the ball 21 rests on the bottom of the housing 18, i.e. on the endpiece 17.

However, when the receptacle is in the head-down position, as shown in FIG. 2, the ball 21 can move to bear against its seat 20, thereby closing the orifice 19.

This prevents the propellant gas G from escaping.

In order to prevent the ball 21 from reaching its seat 20 too easily while the receptacle is in normal use, e.g. in the event of the user moving the receptacle suddenly while it is being used to dispense the fluid P, a retarder 24 may be disposed in the housing 18 in order to slow down displacement of the ball 21 from its dispensing position as shown in FIG. 1 to its closing position as shown in FIG. 2.

In the example described, the retarder 24 presents an outside surface that is configured to constrain the ball to follow a non-rectilinear path between its dispensing and closing position.

More precisely, the retarder 24 in the example shown is in the form of a hollow rod made integrally with the endpiece 17. This rod has an inside channel 26 opening out through an orifice 27 into the inside of the dip tube 16, and it has an outside thread co-operating with the radially inside surface 29 of the spigot 15 to define a substantially helical passage 30 that the ball 21 is constrained to follow in order to reach its position for closing the orifice 19. This passage 30 is defined in part by a surface of the thread 28 that does not converge towards the orifice 19 and that is not parallel to the longitudinal axis of the housing 18 which coincides with the axis X.

The pitch of the thread 28 and its size are selected so as to allow the ball 21 to travel easily along the passage 30 without any risk of it becoming jammed.

The ball 21 is drawn in dotted lines in FIG. 1 in a position partway along the passage 30.

The number of turns of the thread 28 is selected as a function of the delay it is desired to impart to the ball 21 before it reaches its closing position.

It may be observed that in the example shown, the ball 21 is not in a position to be entrained by the flow of fluid inside the inside channel 26 while dispensing is taking place and while the ball is in the passage 30.

Figure 3:
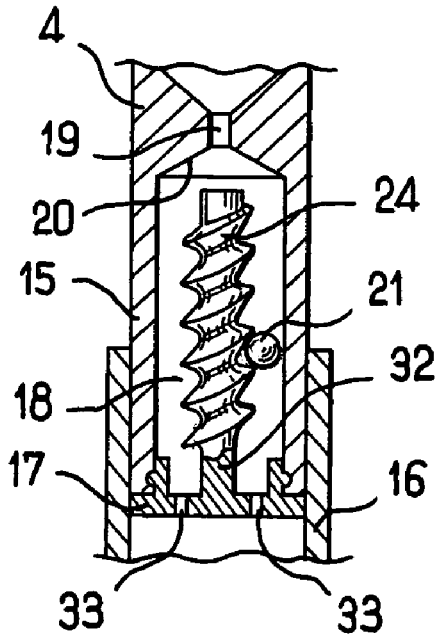
FIG. 3 is a side, elevational, partially sectional, fragmentary view of one embodiment of the valve of the present invention.

The hollow rod of the retarder 24 may be replaced by a solid rod 32 and the fluid may be delivered into the housing 18 by means of one or more orifices 33 formed through the endpiece 17 around the rod 32, as shown in FIG. 3.

Figure 4:
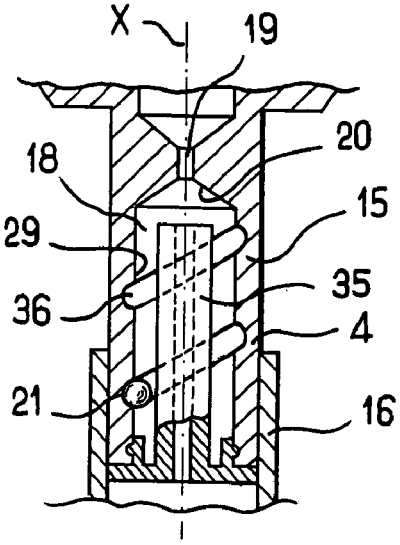
FIG. 4 is a side, elevational, partially sectional, fragmentary view of another embodiment of the valve of the present invention.

The solid or hollow rod need not be threaded, since it is possible for the retarder to constitute a cylindrical rod 35 (which may be hollow as shown in FIG. 4), in association with a helical groove 26 made in the inside surface 29 of the valve body 4.

The rod 35 and the groove 36 are configured in such a manner that the ball 21 necessarily travels along the passage 30 formed between the groove 36 and the rod 35 in order to reach its closing position.

Figure 5:
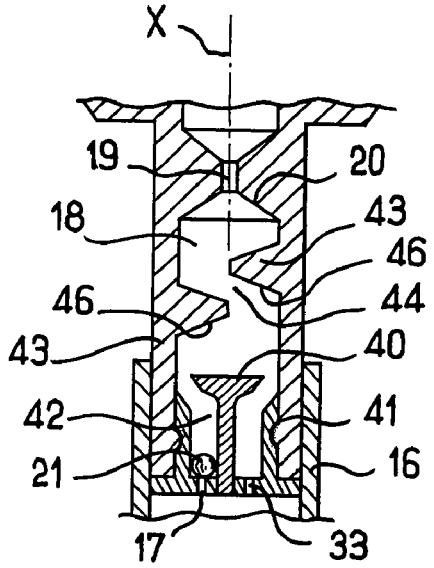
FIG. 5 is a side, elevational, partially sectional, fragmentary view of another embodiment of the valve of the present invention.

In order to slow down the ball 21, it is also possible to use at least one deflector 40, as shown in FIG. 5. By way of example, the deflector 40 may be secured to the endpiece 17, which endpiece may comprise not only the deflector 40 but also a skirt 41 for guiding the ball 21 towards the deflector 40 which presents a surface that does not converge towards the orifice 19.

One or more deflectors 43 may be used in association with or possibly as a replacement for the deflector 40, the deflectors 43 being made integrally with the valve body 4 and serving, for example, to form at least one baffle 44 on the path of the ball from its dispensing position towards its closing position. FIG. 5 shows that the surfaces 46 of the deflectors 43 that are encountered by the ball 21 as it travels towards its closing position do not converge towards the orifice 19.

Furthermore, when the ball 21 is in its closing position and the user presses on the valve rod 5, the chamber 7 takes on atmospheric pressure through the dispensing channel 12, so the ball 21 is pressed against its seat 20 by the pressure difference that exists between the inside of the receptacle and the chamber 7.

In order to enable the ball 21 to return under gravity to its dispensing position, it is possible to provide a micro-leak in the valve body, as described in French patent application FR-A-2 680 161.

Figure 6:
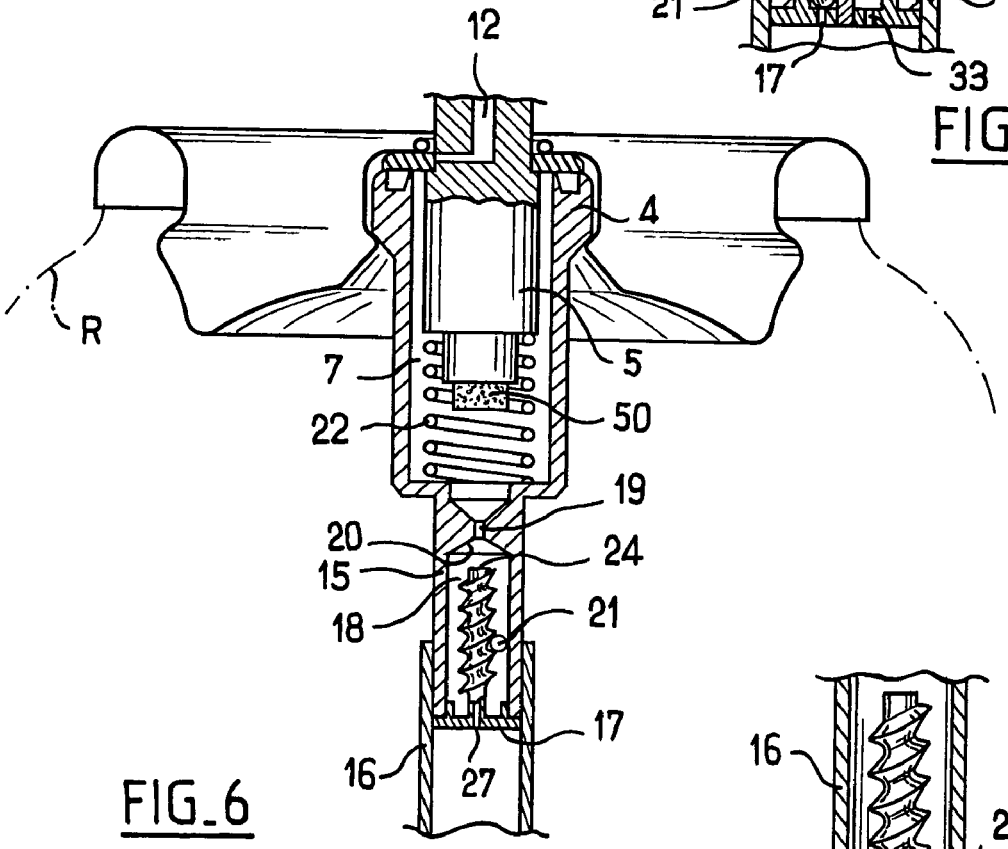
FIG. 6 is a side, elevational, partially sectional, fragmentary view of another embodiment of the valve of the present invention including an absorber.

Nevertheless, it may be more advantageous to replace the micro-orifice with an absorber 50 disposed downstream from the shutter member, for example in the chamber 7, as described below with reference to FIG. 6.

In the example described, the absorber 50 is made of a porous material suitable for absorbing the propellant gas G and possibly also the fluid P.

By way of example, the absorber 50 may comprise fibers of polyamide, in particular nylon, a sintered piece, or a silicone.

The absorber 50 is capable of releasing gas by desorption, thus enabling the pressure inside the chamber 7 to be increased after the valve rod 5 has returned into its closed position, thereby reducing the pressure difference between the upstream and downstream sides of the ball 21.

The absorber 50 is configured so that the volume of gas released by desorption is sufficient to enable the ball 21 to leave its closing position under gravity and/or under the action of the kind of movements that are normally exercised by the user when handling the receptacle.

In the example shown, the absorber 50 is fixed to the end of the valve rod 5, however it could be disposed differently, for example it could be fixed on the valve body.

In the examples described above, the valve is intended for normal use in a head-up position.

It would not go beyond the ambit of the present invention for the valve to be configured so as to enable its normal use to be in a head-down position.

Under such circumstances, the retarder may be disposed on the path of the shutter member between its dispensing position and its closing position, with the displacement of the shutter member from its dispensing position to its closing position taking place downwards under gravity.

Naturally, the invention is not limited to the examples described above.

Figure 7:
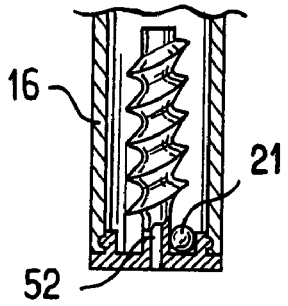
FIG. 7 is a side, elevational, partially sectional, fragmentary view of another embodiment of the valve of the present invention containing the shutter member other than in the valve body.

The housing containing the shutter member could constitute a dip tube fixed to the valve body, as shown in FIG. 7. In this figure, it can be seen that the free end of the dip tube 16 is provided with an endpiece carrying a threaded rod 52 similar to the endpiece 17 and the threaded rod 24 described above.

In particular, it is possible to use a valve rod which controls actuation of the valve not by being depressed, but by being pivoted. The valve could be fixed on the receptacle in some other way.

Throughout the description, including in the claims, the term "comprising a" should be understood as being synonymous with "comprising at least one" unless specified to the contrary.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A valve for use with a pressurized receptacle containing a fluid to be dispensed therefrom, said valve comprising a housing having an axis, and including an orifice for dispensing said fluid, a shutter member disposed in said housing, said shutter member movable along said axis under the action of gravity between a closed position in which said shutter member substantially closes said orifice when said valve is in a predetermined orientation and a dispensing position in which said shutter member releases said orifice, and at least one surface adapted to prevent movement of said shutter member parallel to said axis over at least a portion of the path between said closed position and said dispensing position; wherein said housing is not defined by a dip tube.

2. The valve of claim 1 wherein said at least one surface is adapted to impart a helical motion to said shutter member.

3. The valve of claim 1 wherein said housing includes an inner wall, and said at least one surface comprises a threaded rod including at least one thread which cooperates with said inner wall of said housing to define a substantially helical passage constraining the movement of said shutter member between said closed position and said dispensing position.

4. The valve of claim 1 wherein said housing includes an inner wall, and said at least one surface comprises a helical groove in said inner wall of said housing and a rod within said housing constraining the movement of said shutter member along said helical groove between said closed position and said dispensing position.

5. The valve of claim 3 wherein said threaded rod includes an inner channel for the flow of said fluid towards said orifice.

6. The valve of claim 3 wherein said threaded rod is free of an inner channel which would permit flow of said fluid towards said orifice therethrough.

7. The valve of claim 1 wherein said at least one surface comprises at least one deflector within said housing, said at least one deflector providing an obstacle deflecting the movement of said shutter member between said closed position to said dispensing position.

8. The valve of claim 7 wherein said at least one deflector comprises at least one separate element affixed to the wall of said housing.

9. The valve of claim 7 wherein said at least one deflector comprises at least one integral element formed integrally with said wall of said housing.

10. The valve of claim 1 wherein said housing comprises a valve body.

11. The valve of claim 1 including a valve body, and wherein at least a portion of said housing comprises a separate element affixed to said valve body.

12. The valve of claim 1 including an absorber disposed downstream of said shutter member in the direction of flow of said fluid, said absorber adapted to absorb at least one propellant gas contained within said receptacle, whereby said absorber can release at least a portion of said at least one propellant gas upon a decrease in pressure in the area adjacent to said absorber.

13. The valve of claim 12 wherein said absorber comprises porous material.

14. The valve of claim 12 wherein said absorber comprises a material capable of absorbing said at least one propellant gas.

15. The valve of claim 14 wherein said at least one propellant gas is selected from the group consisting of an alkane, a fluorine-containing compound and dimethyl ether.

16. The valve of claim 12 wherein said absorber comprises polyamide fibers.

17. The valve of claim 12 wherein said absorber comprises a separate sintered member.

18. The valve of claim 12 wherein said absorber comprises silicone.

19. The valve of claim 12 wherein said housing comprises a valve body, and including a chamber in fluid communication with said valve body by means of said orifice, and wherein said absorber is disposed within said chamber.

20. The valve of claim 1 wherein said predetermined orientation comprises a head-down position of said valve, and wherein the position for normal use of said valve comprises a head-up position of said valve.

21. The valve of claim 1 wherein said predetermined orientation comprises a head-up position for said valve, and wherein the position of normal use of said valve comprises a head-down position for said valve.

22. The valve of claim 1 including actuating means for actuating said valve, said actuating means being actuated by being depressed.

23. The value of claim 1 including actuating means for actuating said valve, said actuating means being actuated by being rocked.

24. The valve of claim 15 wherein said alkane is selected from the group consisting of butane, isopropane and isobutane.

25. The valve of claim 15 wherein said fluorine-containing compound is selected from the group consisting of difluoroethane 152*a* and trifluoroethane 134*a*.

26. The valve of claim 16 wherein said polyamide fibers comprise nylon fibers.

27. The valve of claim 17 wherein said separate sintered member comprises a high porosity sintered member.

28. A dispensing device comprising a pressurized receptacle and a valve as defined in claim 1.

29. A valve for use with a pressurized receptacle containing a fluid to be dispensed therefrom, said valve comprising a housing having an axis, and including an orifice for dispensing said fluid, a shutter member disposed in said housing, said shutter member movable along said axis under the action of gravity between a closed position in which said shutter member substantially closes said orifice when said valve is in a predetermined orientation and a dispensing position in which said shutter member releases said orifice, and at least one surface adapted to inhibit the movement of said shutter member over at least a portion of the path between said closed position and said dispensing position; wherein said housing is not defined by a dip tube.

30. A valve for use with a pressurized receptacle containing a fluid to be at least partially dispensed therefrom, said valve comprising a housing and a dip tube said dip tube having a longitudinal axis, and said valve including an orifice for dispensing said fluid, a shutter member disposed in said housing, said shutter member movable under the action of gravity between a closed position in which said shutter member substantially closes said orifice when said valve is in a predetermined orientation and a dispensing position in which said shutter member releases said orifice, and at least one surface adapted to prevent movement of said shutter member parallel to said axis of said dip tube over at least a portion of the path between said closed position and said dispensing position.

31. A valve for use with a pressurized receptacle containing a fluid to be dispensed therefrom, said valve comprising a housing having an axis, and including an orifice for dispensing said fluid, a shutter member disposed in said housing, said shutter member movable along said axis under the action of gravity between a closed position in which said shutter member substantially closes said orifice when said valve is in a predetermined orientation and a dispensing position in which said shutter member releases said orifice, and at least one surface adapted to prevent movement of said shutter member parallel to said axis over at least a portion of the path between said closed position and said dispensing position, wherein said housing includes an inner wall, and said at least one surface comprises a threaded rod including at least one thread which cooperates with said inner wall of said housing to define a substantially helical passage constraining the movement of said shutter member between said closed position and said dispensing position.

32. A valve for use with a pressurized receptacle containing a fluid to be dispensed therefrom, said valve comprising a housing having an axis, and including an orifice for dispensing said fluid, a shutter member disposed in said housing, said shutter member movable along said axis under the action of gravity between a closed position in which said shutter member substantially closes said orifice when said valve is in a predetermined orientation and a dispensing position in which said shutter member releases said orifice, and at least one surface adapted to prevent movement of said shutter member parallel to said axis over at least a portion of the path between said closed position and said dispensing position, wherein said housing includes an inner wall, and said at least one surface comprises a helical groove in said inner wall of said housing and a rod within said housing constraining the movement of said shutter member along said helical groove between said closed position and said dispensing position.

33. A valve for use with a pressurized receptacle containing a fluid to be dispensed therefrom, said valve comprising a housing having an axis, and including an orifice for dispensing said fluid, a shutter member disposed in said housing, said shutter member movable along said axis under the action of gravity between a closed position in which said shutter member substantially closes said orifice when said valve is in a predetermined orientation and a dispensing position in which said shutter member releases said orifice, and at least one surface adapted to prevent movement of said shutter member parallel to said axis over at least a portion of the path between said closed position and said dispensing position, said valve including an absorber disposed downstream of said shutter member in the direction of flow of said fluid, said absorber adapted to absorb at least one propellant gas contained within said receptacle, whereby said absorber can release at least a portion of said at least one propellant gas upon a decrease in pressure in the area adjacent to said absorber.

34. A valve for use with a pressurized receptacle containing a fluid to be dispensed therefrom, said valve comprising a housing having an axis, and including an orifice for dispensing said fluid, a shutter member disposed in said housing, said shutter member movable along said axis under the action of gravity between a closed position in which said shutter member substantially closes said orifice when said valve is in a predetermined orientation and a dispensing position in which said shutter member releases said orifice, and at least one surface adapted to prevent movement of said shutter member parallel to said axis over at least a portion of the path between said closed position and said dispensing position, wherein said predetermined orientation comprises a head-up position for said valve, and wherein the position of normal use of said valve comprises a head-down position for said valve.

* * * * *

UNITED STATES PATENT AND TRADEMARK OFFICE

CERTIFICATE OF CORRECTION

PATENT NO. : 7,014,072 B2
APPLICATION NO. : 10/648006
DATED : March 21, 2006
INVENTOR(S) : Jean-Pierre Yquel It is certified that error appears in the above-identified patent and that said Letters Patent is hereby corrected as shown below:

Column 3, line 20, "pass" should be -- gas --.

Column 10, line 31, "tube said" should be -- tube, said --.

Signed and Sealed this

Fifteenth Day of August, 2006

JON W. DUDAS
*Director of the United States Patent and Trademark Office*